US007361123B1

(12) United States Patent
Krull

(10) Patent No.: US 7,361,123 B1
(45) Date of Patent: Apr. 22, 2008

(54) EXERCISE BENCH METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 627 days.

(21) Appl. No.: 10/794,502

(22) Filed: Mar. 5, 2004

Related U.S. Application Data

(60) Provisional application No. 60/453,476, filed on Mar. 7, 2003.

(51) Int. Cl.
*A63B 21/078* (2006.01)
*A63B 22/00* (2006.01)

(52) U.S. Cl. ..... 482/52; 482/142; 108/116

(58) Field of Classification Search ..... 482/23, 482/25, 26, 51, 52, 74, 79, 92, 93, 140, 142, 482/148, 907, 908, 104, 145, 910; 108/116, 108/125, 128–132, 147.22; 297/423.41, 297/461; D21/671, 690; 5/11, 626, 627
See application file for complete search history.

(56) References Cited

U.S. PATENT DOCUMENTS 2,172,609 A * 9/1939 Fogg ..... 27/12
2,394,245 A * 2/1946 Koller ..... 5/627
2,611,417 A * 9/1952 Henry et al. ..... 280/30
2,831,687 A * 4/1958 Hunter ..... 482/145
3,087,442 A * 4/1963 Berliner ..... 108/19
4,106,413 A * 8/1978 Hoaglund ..... 108/12
4,609,192 A * 9/1986 Bratcher ..... 482/142
4,655,448 A * 4/1987 Harder ..... 482/142
4,759,539 A * 7/1988 Nieppola ..... 482/36
4,927,135 A * 5/1990 Nieppola ..... 482/41
4,984,785 A * 1/1991 Wilkinson ..... 482/52
4,993,706 A * 2/1991 Wilkinson ..... 482/142
5,127,647 A * 7/1992 Wilkinson ..... 482/52
5,256,126 A * 10/1993 Grotstein ..... 482/142
5,277,675 A * 1/1994 Shifferaw ..... 482/30
5,533,948 A * 7/1996 Wilkinson ..... 482/27
5,542,898 A * 8/1996 Wilkinson ..... 482/142
5,637,059 A * 6/1997 Dalebout ..... 482/52
5,642,895 A * 7/1997 Wunder ..... 280/30

(Continued)

FOREIGN PATENT DOCUMENTS

GB 2181658 A * 4/1987

(Continued)

OTHER PUBLICATIONS

Body-Solid, Body-Solid General Specifications, Body-Solid Strength Training Equipment Catalog, copyright 2000.*

*Primary Examiner*—Jerome Donnelly
*Assistant Examiner*—Victor K. Hwang

(57) ABSTRACT

An exercise bench includes a back support and first and second legs pivotally connected to respective ends of the back support. The legs are pivotal between positions extending generally perpendicular to the back support, and positions extending generally parallel to the back support. In addition to facilitating typical bench-related exercises, the bench is available for use as an aerobic step when the legs extend generally parallel to the back support, and as a high-level step when the legs extend generally perpendicular to the back support. Different latching mechanisms may be used to lock the legs in place, and/or the bench may be arranged in an inclined orientation by moving the legs to different positions. Handles and/or foot supports may be provided at one or more ends of the bench, as well.

23 Claims, 4 Drawing Sheets

U.S. PATENT DOCUMENTS 5,769,767 A * 6/1998 Hochberg et al. ..... 482/142
5,842,955 A * 12/1998 Wilkinson ..... 482/52
5,855,536 A * 1/1999 Wilkinson ..... 482/52
6,030,324 A * 2/2000 McBride ..... 482/142
6,173,660 B1 * 1/2001 Emmert ..... 108/90
6,220,995 B1 * 4/2001 Chen ..... 482/140
6,491,608 B1 * 12/2002 Stearns ..... 482/96
6,669,609 B2 * 12/2003 Gerschefske et al. ..... 482/123
6,805,409 B2 * 10/2004 Parker ..... 297/377
7,007,771 B2 * 3/2006 Rawlings et al. ..... 182/33
2005/0148449 A1 * 7/2005 Weir et al. ..... 482/142
2005/0197238 A1 * 9/2005 Parker ..... 482/142
2006/0217249 A1 * 9/2006 Webber ..... 482/142
2007/0087902 A1 * 4/2007 Penat et al. ..... 482/52

FOREIGN PATENT DOCUMENTS

WO WO 2004087264 A1 * 10/2004

* cited by examiner

EXERCISE BENCH METHODS AND APPARATUS

CROSS-REFERENCE TO RELATED APPLICATION

Disclosed herein is subject matter entitled to the filing date of U.S. Provisional Application No. 60/453,476, filed on Mar. 7, 2003.

FIELD OF THE INVENTION

The subject invention relates to exercise methods and apparatus, and more specifically, to benches that support a person during the performance of exercise.

BACKGROUND OF THE INVENTION

Various forms of exercise activities and types of exercise equipment are known in the art. For example, exercise benches are a common type of equipment that is associated with a variety of exercises. Despite many advances in the art, room remains for improved bench designs.

SUMMARY OF THE INVENTION

The present invention provides improved exercise benches and/or bench features. Generally speaking, the present invention may be described in terms of a back support, and first and second legs connected to respective ends of the back support.

One aspect of the present invention is that each leg is pivotally connected to the back support for pivoting between respective positions extending generally perpendicular to the back support, and respective positions extending generally parallel to the back support. The back support is available for use as a bench and/or high step (when the legs extend perpendicular to the back support), and the back support is available for use as a low, aerobic step (when the legs extend parallel to the back support).

According to another aspect of the present invention, latching means are provided on the bench to automatically lock the bench legs in their perpendicular extending positions. A user operated member is movable to release each latch and free the associated leg for movement to its parallel extending position.

According to another aspect of the present invention, at least one leg is pivotal between a first position extending generally perpendicular to the back support, a second position extending generally parallel to the back support and toward the other leg, and a third position extending generally parallel to the back support and away from the other leg. When both legs extend generally perpendicular to the back support, the back support is available for use as a bench and/or a high step. When both legs extend generally parallel to the back support, the back support is available for use as a low step. When one leg extends generally perpendicular to the back support, and the other leg extends generally parallel to the back support, the back support is available for use as an inclined bench. When the "parallel" leg extends away from the "perpendicular" leg, it is available for use as a foot support. Conversely, when the "parallel" leg extends toward the "perpendicular" leg, it leaves an open space in front of the lower end of the inclined back support.

According to yet another aspect of the present invention, at least one of the legs is pivotally connected to an end of the frame by means of a bolt. A plug is configured to engage a floor surface, and is inserted into the same end of the frame. The same bolt extends through the plug to retain the plug inside the end of the frame.

According to still another aspect of the present invention, the back support includes a generally U-shaped frame member having first and second distal end portions at one end, and an intermediate, transverse portion at an opposite end. The transverse portion is sized and configured for grasping. The legs are secured to respective ends of the frame member, and at least the leg at the one end is pivotal between a first position extending generally perpendicular to the back support, and a second position extending generally parallel to the back support.

Various features and/or advantages of the present invention, as well as combinations of the foregoing features, may become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
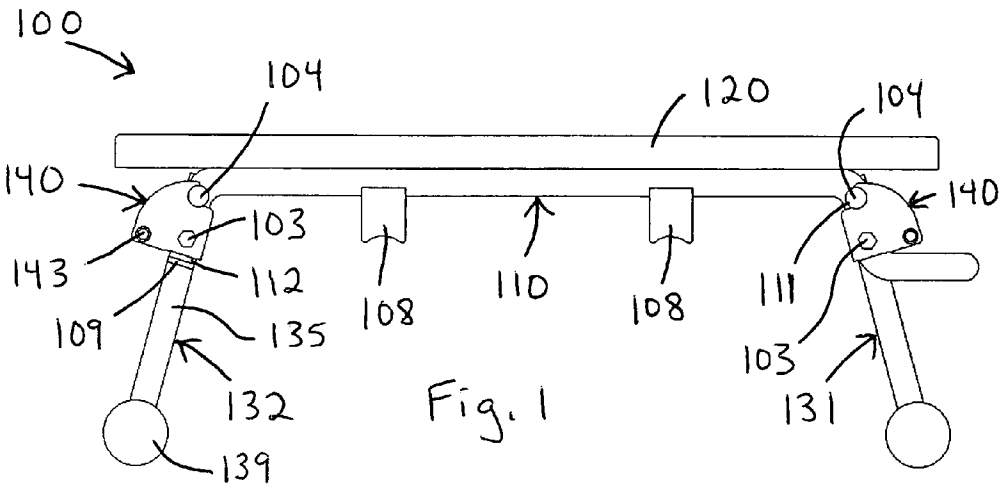
FIG. 1 is a side view of a preferred embodiment exercise bench constructed according to the principles of the present invention, and arranged in a first configuration.
Figure 2:
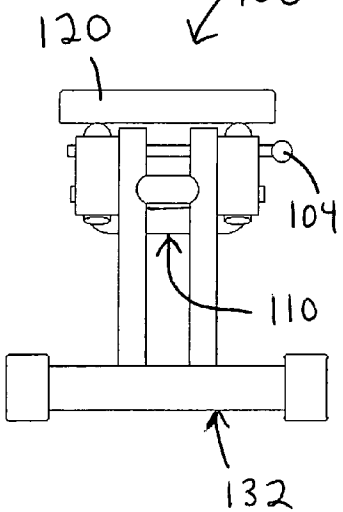
FIG. 2 is an end view of the exercise bench of FIG. 1.
Figure 3:
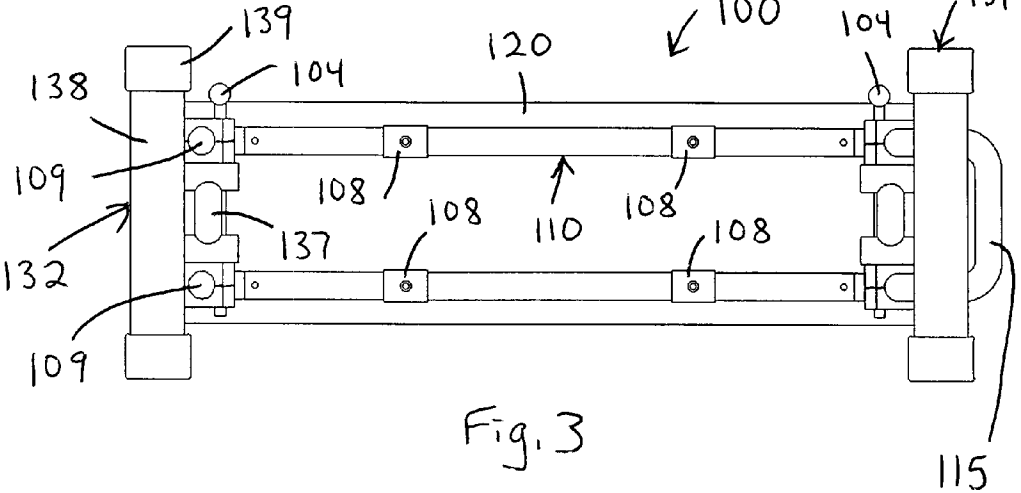
FIG. 3 is a bottom view of the exercise bench of FIG. 1.

An exercise bench constructed according to the principles of the present invention is designated as 100 in FIGS. 1-6. The bench 100 may be described generally in terms of a back support 120 and first and second legs 131 and 132 movably connected to respective ends of the back support.

The back support 120 may be any of various types known in the art, and preferably includes a cover disposed about a padding material and an underlying board. The back support 120 is preferably thirty-six to forty inches long.

The back support 120 is mounted on a frame member 110 in such a manner that the board portion of the back support 120 bears against the frame member 110. Screws are preferably inserted through the frame member 110 and threaded into the board (or bolts are inserted through the frame member 110 and threaded into inserts in the board). Some of the screws (or bolts) preferably serve the additional function of mounting bumpers 108 on the frame member 110 (for reasons discussed below).

The frame member 110 is preferably a cylindrical tube having an outside diameter of one and one-quarter inches, and arranged into a U-shaped configuration that extends between a first end 111 and a second end 112. The second end 112 terminates at opposite distal ends of the frame member 110, and the first end 111 terminates at a transversely extending portion 115 of the frame member 110. The transverse member 115 may also be described as a handle that is sized and configured for grasping.

Figure 7:
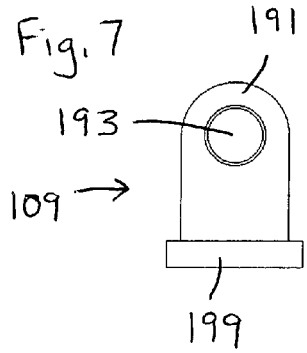
FIG. 7 is a side view of a plug that is a component on the exercise bench shown in FIGS. 1-6.

A plug 109 is inserted into each distal end of the frame member 110. One such plug 109 is shown by itself in FIG. 7. The plug 109 includes a cylindrical body 191 having a rounded head or lead portion. A hole 193 extends through the body 191 proximate the head, and each end of the hole 193 is beveled outward to facilitate insertion of a bolt. An opposite, trailing portion of the body 191 terminates in a relatively larger diameter lip or foot 199. If desired, the foot 199 may be provided with an opening for a tool and/or configured eccentrically to facilitate orientation of the plug 109 within a tube during assembly of the bench 100. In any event, the plug 109 is inserted into a distal end of the frame member 110 and arranged so that the hole 193 aligns with a hole in the frame member 110 (to receive a bolt 103 that is further discussed below) as the lip 199 encounters the end of the frame member 110.

A bushing 140 is mounted on each distal end portion of the frame member 110, and similar bushings 140 are mounted on opposing portions of the frame member 110 proximate the opposite end 111. Each bushing 140 is preferably a complementary pair of molded plastic parts that register with one another and define a bore sized and configured to surround a respective portion of the frame member 110. The two parts or "halves" may be secured together by adhesives, sonic welding, a respective bolt 103, and/or other means known in the art. Three additional openings are preferably provided in the bushing 140, extending in a direction transverse to the bore. One of these openings is a hole that intersects the bore and aligns with the hole for the plug 109 or a similar hole at the opposite end 111 of the frame member 110 (to receive one of the bolts 103 that are further discussed below).

Each leg 131 and 132 includes first and second cylindrical tubes 135 that are preferably similar in diameter to the frame member 110. The tubes 135 are interconnected by a similar size tube or brace 137 proximate one end, and the tubes 135 are interconnected by a relatively larger diameter tube 138 at their opposite ends. End cap rollers 139 of a type known in the art are mounted on the opposite ends of the tube 138 to engage and selectively roll across a floor surface 90. A respective hole for a bolt 103 extends transversely through each tube 135 and co-axially through the intermediate brace 137 to receive the bolt 103. Each bolt 103 is inserted through a bushing 140 and an associated portion of the frame member 110, through the tubes 135 and the brace 137, and through another bushing 140 and associated portion of the frame member 110, and then connected to a mating nut. The bolts 103 pivotally connect respective legs 131 and 132 to the frame member 110, and secure the plugs 109 in place (at the second end 112), and may secure the respective bushing "halves" together, as well.

Figure 5:
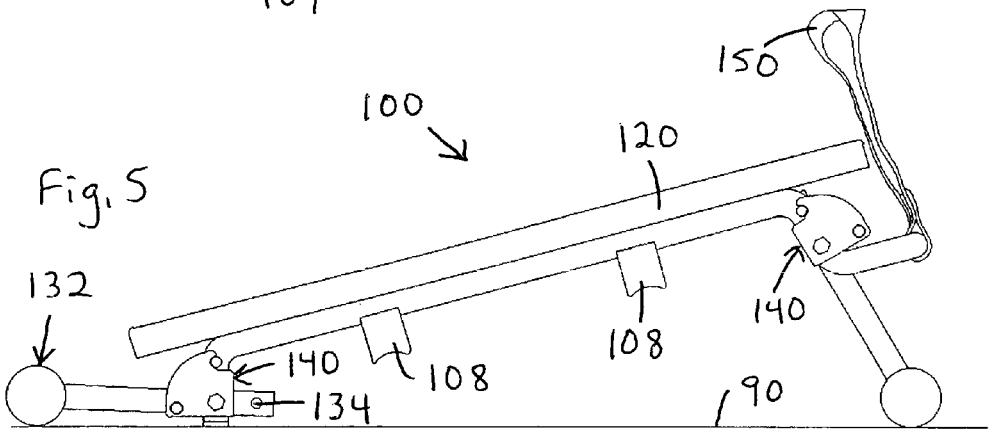
FIG. 5 is a side view of the exercise bench of FIG. 4 arranged in a third configuration (and shown with the latching rods removed)

As shown in FIG. 5, a hole 134 extends transversely through the tubes 135 on each leg 131 and 132 at a common radial distance from a respective bolt 103. Each such hole 134 aligns with one of the openings in a respective bushing 140 when the legs 131 and 132 are pivoted to the positions shown in FIG. 6. When the legs 131 and 132 are so arranged, respective latch pins 104 may be inserted through the aligned holes in respective bushings 140 and respective legs 131 and 132 to latch the bench 100 in the position shown in FIG. 6.

Figure 6:
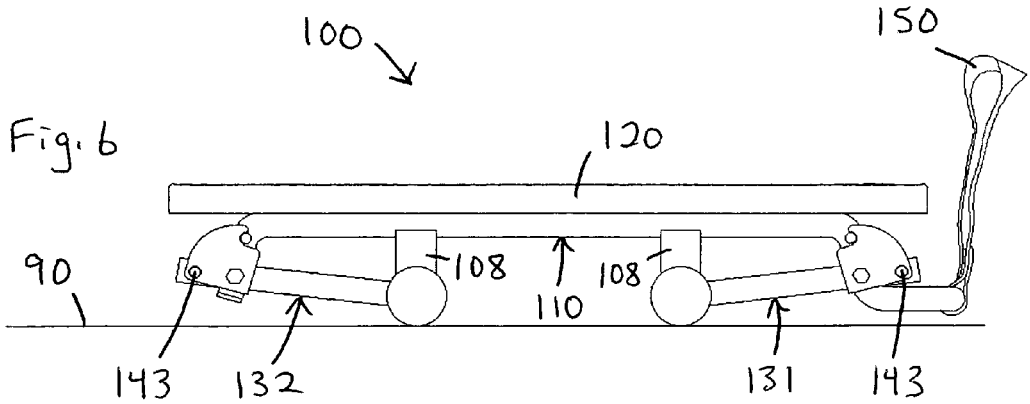
FIG. 6 is a side view of the exercise bench of FIG. 4 arranged in a fourth configuration (and shown with the latching rods removed)

When configured as shown in FIG. 6 (with the latch pins 104 removed), the bench 100 is suitably arranged for facilitating "low step" exercises. In this regard, the upper surface of the back support 120 is preferably six to eight inches above the underlying floor surface 90. Also, the bumpers 108 are sandwiched between respective portions of the frame member 110 and respective leg members 138. The bumpers 108 are preferably made of rubber to absorb impact associated with stepping exercise, and configured to match the contours of the members in contact with them.

When configured as shown in FIG. 6 (with the latch pins 104 inserted through respective holes 143), the bench 100 is suitably arranged for storage and/or transportation. FIG. 6 shows an optional strap 150 having first and second ends formed into closed loops about the transverse member 115 (by stitching, for example), and an intermediate portion that is available for grasping. Among other things, the strap 150 may be used to pull the bench 100 out from under a bed, and/or to lift the associated end of the bench 100 upward from the floor surface 90.

Figure 8:
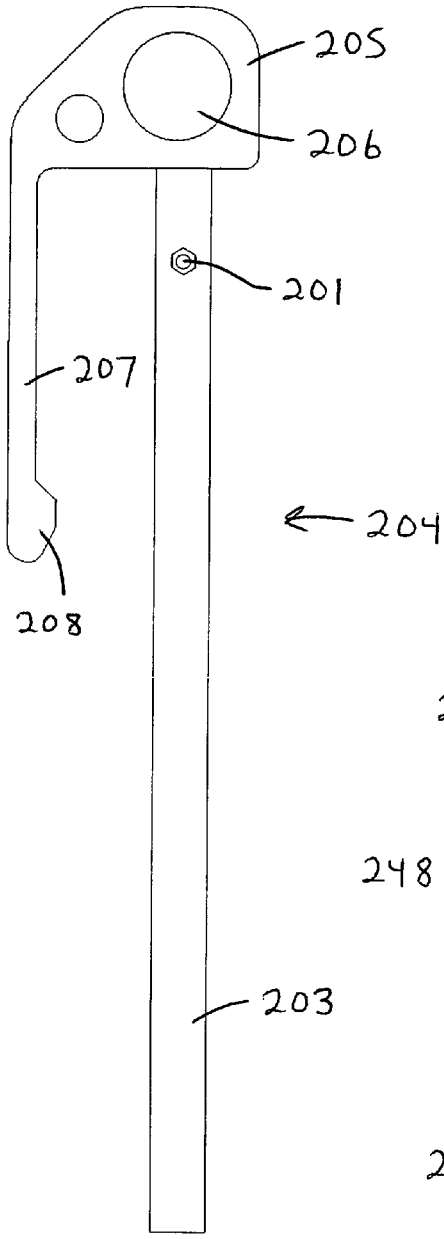
FIG. 8 is a side view of an alternative embodiment latching rod suitable for use on the exercise bench of FIGS. 1-6.
Figure 9:
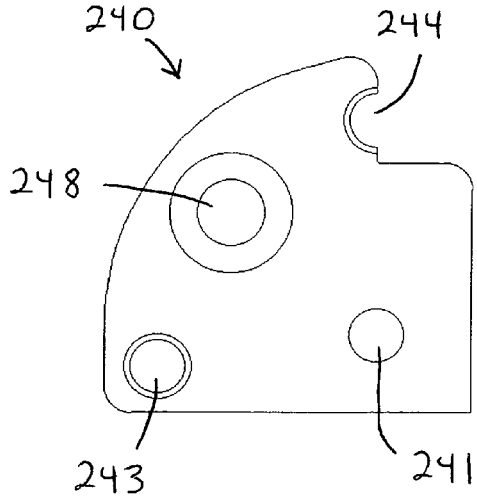
FIG. 9 is a side view of an alternative embodiment bushing suitable for use with the latching rod of FIG. 8.

Each latch pin 104 is a ball detent pin of a type known in the art. However, as shown in FIGS. 8-9, other latching arrangements may be used without departing from the scope of the present invention. FIG. 8 shows a latch pin 204 having a steel tube 203, and a plastic handle 205 that is connected to the tube 203 by means of a screw 201. In this regard, the handle 205 includes a rod portion that extends into the tube 203. A hole 206 extends through the handle 205 to facilitate handling, and a smaller hole may be provided, as well, to accommodate a tether (if desired). A leaf spring 207 projects outward from the handle 205 and parallel to the tube 203, and a nub 208 is disposed on the distal end of the leaf spring 208.

FIG. 9 shows an alternative embodiment bushing configured for use with the latch pin 204. The bushing 240 has openings 241, 243, and 244 similar to those in the bushing 140 shown in FIGS. 1-6. The bushing 240 has an additional, larger opening 248 that is sized and configured to receive the distal end of the leaf spring 207 (including the nub 208) in snap fit fashion when the tube 203 is inserted into either of the openings 243 or 244. The bushing 240 may be formed the same way and have the same bore as the bushing 140, or either type of bushing may alternatively be formed as a single piece with a U-shaped channel that extends vertically and opens toward the right in FIG. 9.

Figure 4:
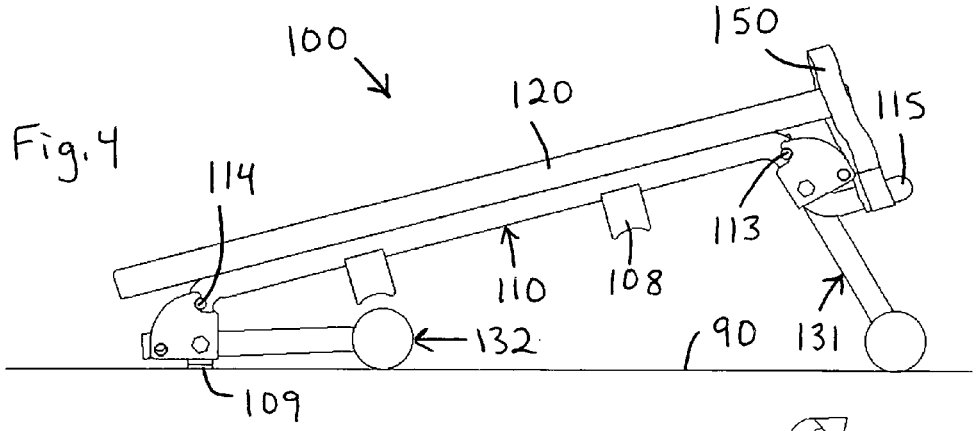
FIG. 4 is a side view of the exercise bench of FIG. 1 arranged in a second configuration, and shown with an optional strap attached thereto (and with the latching rods removed)

As shown in FIG. 4, holes 113 and 114 extend transversely through respective portions of the frame member 110 at a common radius from the holes for the bolts 103. The holes 113 and 114 are configured and arranged to align with the holes 244 in the bushings 240 or the similar holes in the bushings 140. They also align with the holes 134 on respective legs 131 and 132 when the legs 131 and 132 are pivoted to the positions shown in FIG. 1. When the legs 131 and 132 are so arranged, respective latch pins 104 may be inserted through the aligned holes to latch the bench 100 in the configuration shown in FIG. 1.

When configured as shown in FIG. 1 (with the latch pins 104 in place), the bench 100 is suitably arranged for facilitating "high step" exercises. In this regard, the upper surface of the back support 120 is preferably fifteen to seventeen inches above the underlying floor surface 90. The bench 100 is also suitably arranged for performing various conventional bench exercises, including sit-ups, dumbbell fly exercises, and bench press exercises, for example.

In FIG. 1, the back support 120 extends parallel to the underlying floor surface, and the legs 131 and 132 define respective angles of seventy-five degrees relative to the back support 120 (and the floor surface). The legs 131 and 132 may alternatively be described as extending substantially perpendicular to the back support 120 (and the floor surface).

FIGS. 4 and 5 show the bench 100 in two different inclined positions relative to the underlying floor surface 90. In each of these arrangements, the back support 120 defines an angle of fifteen degrees relative to the floor surface 90, and the distal end segments of the frame member 110 extend perpendicular to the floor surface. A latch pin 104 must be inserted through the hole 113 to maintain the leg 131 in the depicted orientation relative to the back support 120, and the other latch pin 104 may be inserted through the hole 114 for storage purposes.

In FIG. 4, the leg 132 is pivoted to extend substantially parallel to the back support 120 and toward the opposite leg 131. This arrangement leaves the floor space "forward" of the lower end 112 of the back support 120 free of obstruction (to accommodate a person's head, or a towel or pillow to support a person's head, if desired). When configured as shown in FIG. 4, the bench 100 may be described as a "declined bench" that is suitable for performing inclined sit-ups and declined presses, among other things. FIG. 4 shows the optional strap 150 straddling the back support 120 in a manner that would anchor a person's feet during sit-up exercises.

In FIG. 5, the leg 132 is pivoted to extend substantially parallel to the back support 120 and away from the opposite leg 131. This arrangement makes the tube 138 on the leg 132 available for use as a foot support. When configured as shown in FIG. 5, the bench 100 may be described as an "inclined bench" that is suitable for performing inclined bench presses and leg lifts, among other things. FIG. 5 shows the optional strap 150 projecting upward above the back support 120 to serve as a hand anchor during leg lift exercises.

Figure 10:
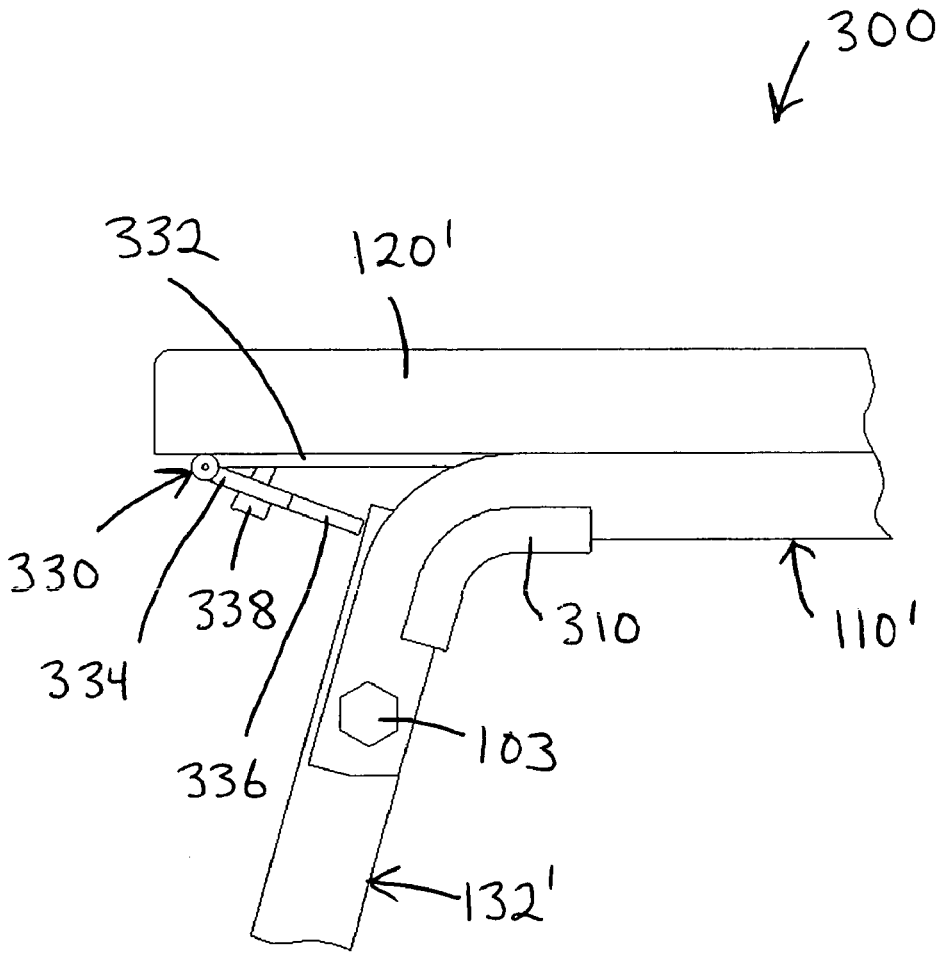
FIG. 10 is a side view of a portion of an alternative embodiment bench having yet another leg latching arrangement.

FIG. 10 shows an alternative embodiment bench 300 that is similar to the bench 100 except for the manner in which the legs 132' are latched relative to the frame 110'. As shown in FIG. 10, a stop bracket 310 is rigidly secured to opposite sides of the frame 110' (by welding, bolts, or other suitable means) to limit clockwise pivoting of the leg 132' (to the position shown in FIG. 10). In other words, the upper ends of the leg tubes 135 bear against respective intermediate portions of the stop bracket 310, when the leg 132' occupies the position shown in FIG. 10. Because of the angle of the leg 132', the weight of the bench 300 and any user on the bench 300 imposes a clockwise moment force on the leg 132', thereby encouraging the leg 132' to remain against the stop bracket 310.

FIG. 10 also shows a hinged latching mechanism 330 on the bench 300 to reduce the likelihood of the leg 132' inadvertently pivoting counterclockwise away from the stop bracket 310. The mechanism 330 includes a base plate 332 that is secured to the bottom side of the body support 120', and a hinge plate 334 that is pivotally connected to the base plate 332. The hinge plate 334 pivots between a latched position (shown in FIG. 10), overlying the upper ends of the leg tubes 135, and an unlatched position, extending relatively more parallel to the base plate 332. A peg 338 or other suitable fastener extends through a slot in the hinge plate 334, and is rigidly secured to the base plate 332 (by welding or other suitable means). The peg 338 limits downward pivoting of the hinge plate 334 to the position shown in FIG. 10. Tabs 336 project outward from opposite sides of the hinge plate 334 to facilitate lifting of the hinge plate 334 to the unlocked position.

When positioned as shown in FIG. 10, the hinge plate 334 resists counter-clockwise pivoting of the leg 132', and preferably, the components are arranged in such a manner that counter-clockwise pivoting of the leg 132' presses the hinge plate 334 downward rather than upward. In other words, the hinge plate 334 pivots slightly past perpendicular relative to the leg 132' to reach its locked position. To free the leg 132' for pivoting to its folded position, a user simply lifts up on one of the tabs 336, and then pushes or pulls the leg to pivot counter-clockwise past the hinge plate 334.

Another alternative latching arrangement involves the use of a bolt or gate that slides up and down along a slot extending parallel to the leg when positioned like the leg 132' shown in FIG. 10. The bolt is movable between a locked position, proximate the distal end of the hinge plate 334 in FIG. 10, and an unlocked position, preferably above the leg (but alternatively below the pivot axis of the leg).

The present invention may also be described in terms of various methods with reference to the foregoing embodiments. For example, the present invention provides a method of performing cross-training exercise, comprising the steps of providing a bench having a back support and first and second legs pivotally connected to respective ends thereof; pivoting the legs to respective first positions to support the back support at a first elevation above the floor surface to define an aerobic step, and performing aerobic step exercise; and subsequently pivoting the legs to respective second positions to support the back support at a relatively higher, second elevation above the floor surface to define a weight lifting bench, and performing weight lifting exercise.

The foregoing description and accompanying drawings are directed toward specific embodiments and applications with the understanding that this disclosure will enable persons skilled in the art to realize other variations and/or derive additional embodiments. Accordingly, the scope of the present invention should be limited only to the extent of the following claims.

What is claimed is:

1. An exercise bench, comprising:

a back support having a first end and a second end;

a first leg configured to engage a floor surface, and pivotally connected to the first end of the back support;

a second leg configured to engage a floor surface, and pivotally connected to the second end of the back support, wherein the second leg is pivotal between a first position extending generally perpendicular to the back support in a manner that supports the second end of the back support at a first elevation relative to the floor surface, a second position extending generally parallel to the back support and toward the first end of the back support in a manner that supports the second end of the back support in a lower, second elevation relative to the floor surface, and a third position extending generally parallel to the back support and away from the first end of the back support in a manner that allows the second end of the back support to occupy a still lower, third elevation relative the floor surface.

2. The exercise bench of claim 1, wherein the first leg is pivotal between a respective said first position extending generally perpendicular to the back support, and a respective said second position extending generally parallel to the back support and toward the second end of the back support.

3. The exercise bench of claim 2, wherein at least one bumper is mounted on the back support and arranged to be sandwiched between the back support and at least one said leg when each said leg occupies a respective said second position.

4. The exercise bench of claim 3, wherein the second leg includes a floor engaging member that extends transversely relative to the back support, and the at least one bumper includes first and second bumpers that are arranged to engage opposite ends of the floor engaging member.

5. The exercise bench of claim 3, wherein each said leg includes a transversely extending base portion, and the at least one bumper includes bumpers configured and arranged to engage each said base portion.

6. The exercise bench of claim 3, wherein a distance between six inches and eight inches is defined between an upper surface of the back support and an underlying floor surface when each said leg occupies a respective said second position.

7. The exercise bench of claim 6, wherein a distance between fourteen and sixteen inches is defined between the upper surface and the floor surface when each said leg occupies a respective said first position.

8. The exercise bench of claim 2, wherein the back support includes a frame portion, and an end of the frame portion proximate the second end of the back support is configured to engage an underlying floor surface when the first leg occupies its respective said first position and when the second leg occupies its respective said third position.

9. The exercise bench of claim 8, wherein at least one floor engaging plug is inserted into the end of the frame portion, and a bolt extends transversely through the plug, the end of the frame portion, and the second leg.

10. The exercise bench of claim 1, wherein the second leg includes a floor engaging member that extends transversely relative to the back support, and the transversely extending member has opposite ends that are configured and arranged to support the feet of a person lying supine on the back support when the second leg occupies the third position.

11. An exercise bench, comprising:

a back support having a first end and a second end, and including a frame portion, wherein at least one floor engaging plug is inserted into an end of the frame portion proximate the second end of the back support;

a first leg configured to engage a floor surface, and pivotally connected to the first end of the back support;

a second leg configured to engage a floor surface, wherein a bolt extends transversely through the second leg, the plug, the end of the frame portion, and wherein each said leg is pivotal between a respective first position extending generally perpendicular to the back support, and a respective second position extending generally parallel to the back support, and the plug engages an underlying floor when the second leg occupies its second position and the first leg occupies its first position; and at least one rubber bumper is mounted on at least one of the back support and one said leg and arranged to be compressed between the back support and at least one said leg when each said leg occupies a respective said second position.

12. The exercise bench of claim 11, wherein at least one said leg includes a floor engaging member that extends transversely relative to the back support, and the at least one bumper includes first and second rubber bumpers that are arranged to engage opposite ends of each said floor engaging member.

13. The exercise bench of claim 11, wherein each said leg includes a transversely extending base portion, and the at least one bumper includes respective rubber bumpers configured and arranged to engage each said base portion.

14. The exercise bench of claim 11, wherein a distance between six inches and eight inches is defined between an upper surface of the back support and an underlying floor surface when each said leg occupies a respective said second position.

15. The exercise bench of claim 14, wherein a distance between fourteen and sixteen inches is defined between the upper surface and the floor surface when each said leg occupies a respective said first position.

16. The exercise bench of claim 11, wherein the second leg includes a floor engaging member that extends transversely relative to the back support, and the transversely extending member has opposite ends that are configured and arranged to support the feet of a person lying supine on the back support when the second leg extends generally parallel to the back support and away from the first end.

17. An exercise bench, comprising:

a frame having a first end and a second end;

a back support mounted on the frame;

a first leg configured to engage a floor surface, and connected to the first end of the frame;

a second leg configured to engage a floor surface;

a bolt that extends through the second leg and the second end of the frame to pivotally connect the second leg to the frame, wherein the second leg is pivotal between a first position extending generally perpendicular to the back support, and a second position extending generally parallel to the back support; and a plug configured to engage a floor surface, and inserted into the second end of the frame, wherein the bolt extends through the plug to retain the plug inside the second end of the frame.

18. An exercise bench, comprising:

a generally U-shaped bar having first and second distal end portions at one end, transverse portion at an opposite end, and parallel first and second intermediate segments extending therebetween wherein the transverse portion is sized and configured for grasping, and the distal end portions are sized and configured to engage a floor surface;

a back support mounted on top of the first and second intermediate segments of the bar;

a first leg configured to engage a floor surface, and connected to the bar proximate the opposite end; and a second leg configured to engage a floor surface, and connected to the bar proximate the one end, wherein at least the second leg is pivotal between a first position extending generally perpendicular to the back support, and a second position extending generally parallel to the back support.

19. The exercise bench of claim 18, further comprising at least one strap secured about the transverse portion.

20. The exercise bench of claim 18, further comprising a strap having opposite ends secured to the transverse portion.

21. An exercise bench, comprising:

a back support having a first end and a second end;

a first leg configured to engage a floor surface, and having an intermediate portion pivotally connected to the first end of the back support; and a second leg configured to engage a floor surface, and having an intermediate portion pivotally connected to the second end of the back support, wherein each said leg is selectively pivotal between a respective first position, supporting the back support at a first elevation above the floor surface to define an aerobic step, and a respective second position, supporting the back support at a relatively higher, second elevation above the floor surface to define a weight lifting bench, wherein each said leg has a first end that engages the floor surface in each said position, and an opposite, second end that is releasably secured to a respective said end of the bench in the second position.

22. The exercise bench of claim 21, wherein respective bumpers on the back support are sandwiched between the back support and each said leg when each said leg occupies its first position.

23. The exercise bench of claim 21, wherein frame members on the back support engage the floor surface when at least one said leg occupies a discrete, third position.

* * * * *